US007895924B2

(12) United States Patent
Hsieh

(10) Patent No.: US 7,895,924 B2
(45) Date of Patent: Mar. 1, 2011

(54) SOCKET CONNECTION DEVICE

(76) Inventor: Chih-Ching Hsieh, Taichung Hsien (TW)

( * ) Notice: Subject to any disclaimer, the term of this patent is extended or adjusted under 35 U.S.C. 154(b) by 181 days.

(21) Appl. No.: 12/355,825

(22) Filed: Jan. 19, 2009

(65) Prior Publication Data

US 2010/0180734 A1 Jul. 22, 2010

(51) Int. Cl.
*B25B 23/16* (2006.01)

(52) U.S. Cl. ..... 81/177.85

(58) Field of Classification Search ..... 81/177.85, 81/177.1, 177.2; 403/328
See application file for complete search history.

(56) References Cited

U.S. PATENT DOCUMENTS 4,187,747 A * 2/1980 Pawlow ..... 81/177.85
4,297,924 A * 11/1981 Stephens ..... 81/59.1
4,317,392 A * 3/1982 Stephens et al. ..... 81/63.1
4,614,457 A * 9/1986 Sammon ..... 403/322.2
5,685,208 A * 11/1997 Tidwell ..... 81/177.85
6,062,112 A * 5/2000 Bonniot ..... 81/177.85
6,295,896 B1 * 10/2001 I-He ..... 81/63
7,013,766 B2 * 3/2006 Lee ..... 81/177.85
7,066,055 B1 * 6/2006 Lee ..... 81/63
7,082,863 B1 * 8/2006 Wang ..... 81/177.85
7,240,590 B1 * 7/2007 Lin ..... 81/63
2006/0144196 A1 * 7/2006 Lee ..... 81/63
2007/0199412 A1 * 8/2007 Lee ..... 81/177.85

* cited by examiner

*Primary Examiner*—David B Thomas
(74) *Attorney, Agent, or Firm*—Ming Chow; Sinorica, LLC

(57) ABSTRACT

A socket connection device including a main body; a slide rod installed in the main body and slidable along the main body, a shallow depression and a deep depression being formed on a front end of the slide rod; and a ball body inlaid in a through hole of the main body. In normal state, a bottom edge of the ball body falls on the shallow depression and a top edge of the ball body protrudes out of the main body. When the slide rod moves to a position where the deep depression is aligned with the through hole, the ball body moves into the deep depression without protruding out of the main body. In the invention, a center of the ball body is positioned outside a bottom wall of the shallow depression. When fitting a socket on the connection device, the socket presses the ball body to drive the slide rod slide, whereby the ball body drops into the deep depression. Therefore, the socket can be directly connected with the device without performing any additional operation.

10 Claims, 8 Drawing Sheets

SOCKET CONNECTION DEVICE

FIELD OF THE INVENTION

The present invention is related generally to a hand tool, and more particularly to a socket connection device.

BACKGROUND OF THE INVENTION

FIG. 1 shows a conventional socket connection device 10 including a main body 11 and a slide rod 12 disposed in a slide passage 13 of the main body. One end of the slide rod 12 is formed with a shallow depression 14 and a deep depression 15. A steel ball 16 is inlaid in a through hole 17 of the main body. In normal state, the slide rod 12 is resiliently urged by a spring 18 and tends to move rightward according to FIG. 1. In this state, the shallow depression 14 is right under the through hole 17 and the steel ball 16 falls into the shallow depression 14 with its top edge outward protruding from the main body 11. When pushing a push rod 19, the slide rod 12 is moved leftward and the deep depression 15 is displaced to a position under the through hole 17. At this time, the steel ball falls into the deep depression 15 and retracts into the main body.

When fitting with a socket, the push rod 19 is first pressed to move the slide rod 12 and retract the steel ball 16 into the main body 11. Under such circumstance, the socket can be fitted with an insertion end 111 of the main body. Then, the push rod is released from the pressing force, whereby the spring 18 pushes the slide rod back to its home position where the steel ball again moves into the shallow depression 14. In this state, the steel ball protrudes from the main body to engage with a wall of a fitting hole of the socket. When taking off the socket, the push rod 19 is pushed to move the steel ball 16 into the main body and disengage the steel ball from the socket. At this time, the socket can be separated from the connection device 10.

According to the conventional socket connection device, no matter when connecting with the socket or disconnecting from the socket, a user needs to first press or pull the push rod to move the slide rod and retract the steel ball into the main body. This is quite inconvenient to the user.

It is impossible for the user to forcedly fit the socket with the main body without first retracting the steel ball into the main body. This is because that as shown in FIG. 2, the shallow depression 14 has an axial length L larger than the radius of the steel ball. That is, the center C, or to say the bottommost edge, of the steel ball falls onto a bottom wall 141 of the shallow depression 14. Therefore, when the socket touches the steel ball and exerts a pushing force onto the steel ball, the force exerted onto the steel ball is directly applied to the bottom wall 141 of the shallow depression 14. Therefore, it is impossible to make the slide rod 12 move. Accordingly, no matter how great the force exerted onto the steel ball by the socket is, the steel ball cannot be retracted into the main body.

SUMMARY OF THE INVENTION

It is therefore a primary object of the present invention to provide a socket connection device. A socket can be directly connected with the socket connection device without performing any pressing or pulling operation.

According to the above object, the socket connection device of the present invention includes: a main body; a slide rod installed in a slide passage of the main body and slidable along the slide passage; a shallow depression and a deep depression being formed on a circumference of a front end of the slide rod; and a ball body inlaid in a through hole formed on a circumference of the main body. In normal state, the slide rod is elastically pushed by a resilient member and the shallow depression is aligned with the through hole, a bottom edge of the ball body falls on the shallow depression and a top edge of the ball body protrudes out of the main body. When the slide rod moves so that the deep depression is aligned with the through hole, the ball body moves into the deep depression without protruding out of the main body.

In the normal state, a center of the ball body of the invention is positioned outside a bottom wall of the shallow depression. Therefore, when connecting a socket with the socket connection device, the socket presses the ball body to drive and make the slide rod slide, whereby the ball body drops into the deep depression and retracts into the main body. Therefore, the socket can be directly connected with the socket connection device.

Preferably, in an axial direction of the slide rod, an axial length of the shallow depression is shorter than a radius of the ball body.

The present invention can be best understood through the following description and accompanying drawings wherein:

DETAILED DESCRIPTION OF THE PREFERRED EMBODIMENTS

Figure 2:
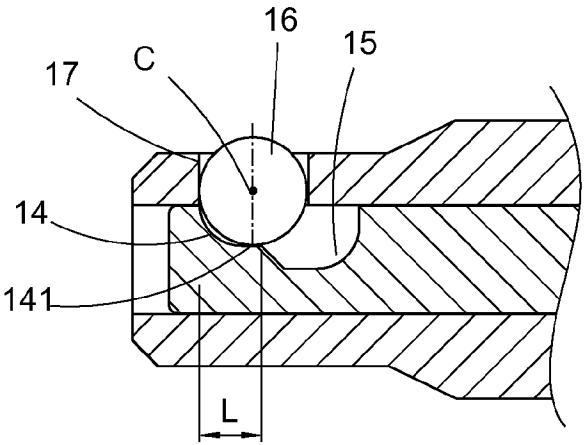
Fig. 2 PRIOR ART
FIG. 2 is an enlarged view of a part of FIG. 1.
Figure 1:
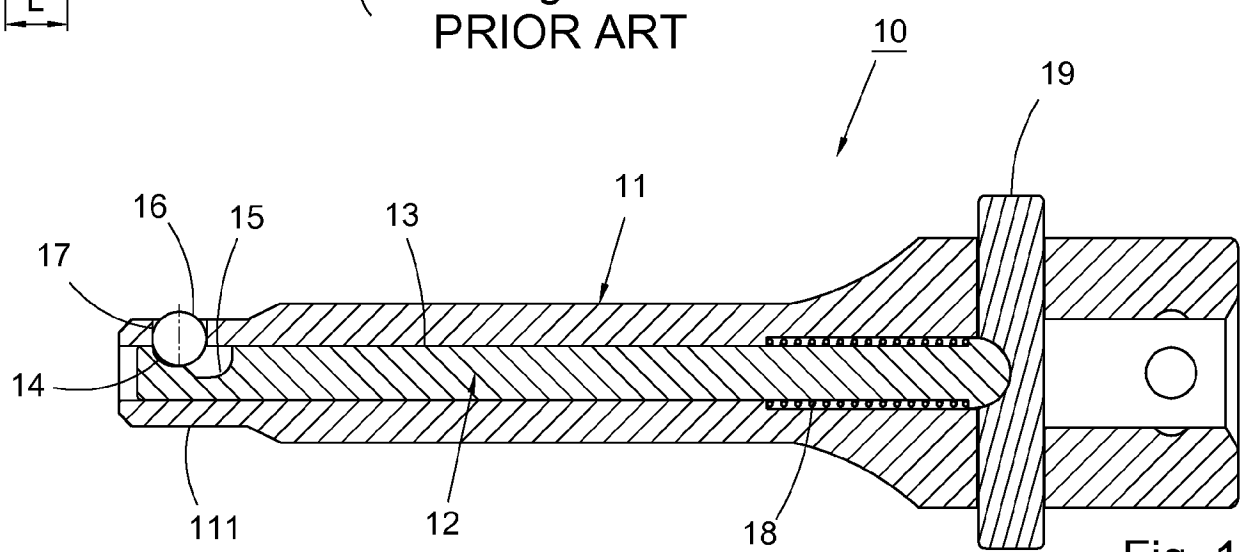
Fig. 1 PRIOR ART
FIG. 1 is a longitudinal sectional view of a conventional socket connection device.
Figure 11:
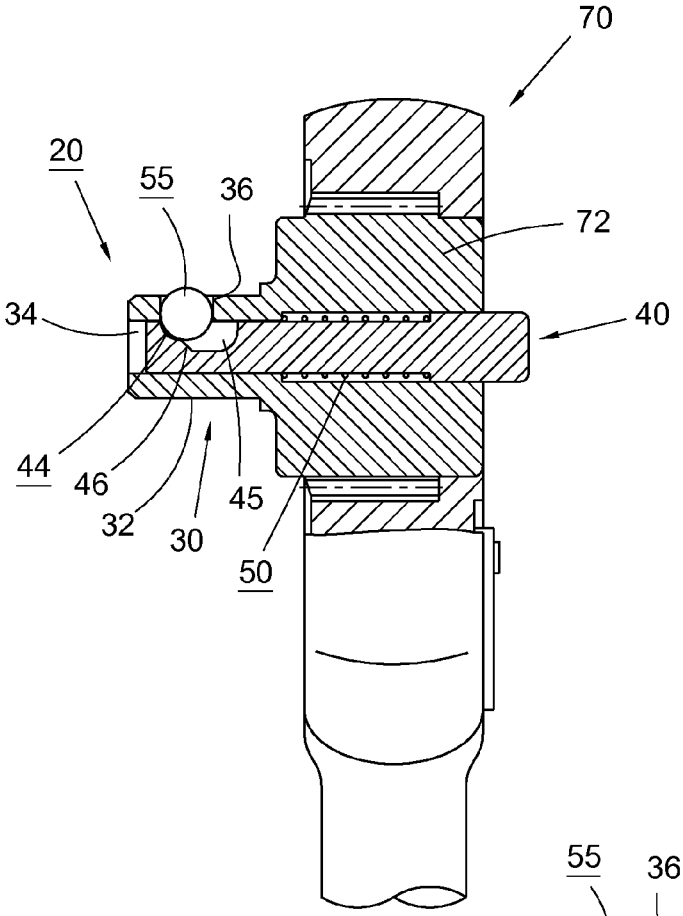
FIG. 11 is a partially sectional of a second embodiment of the present invention.
Figure 13:
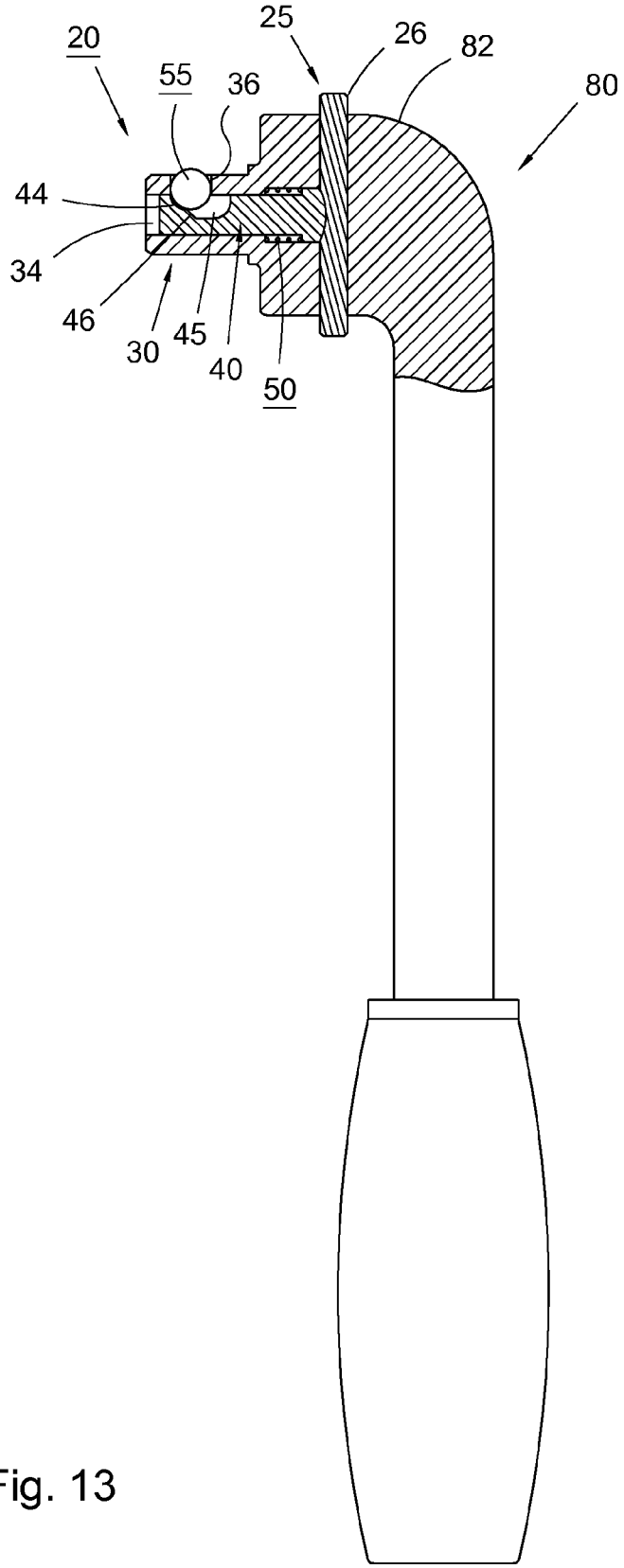
FIG. 13 is a partially sectional of a third embodiment of the present invention.

The socket connection device 20 of the present invention can be an independent socket connection rod as shown in FIG. 1. Alternatively, the socket connection device 20 of the present invention can be applied to a ratchet wrench 70 as an internal component of a ratchet 72 of the ratchet wrench 70 as shown in FIG. 11. Still alternatively, the socket connection device 20 of the present invention can be applied to a socket wrench 80 as an internal component thereof as shown in FIG. 13.

Figure 3:
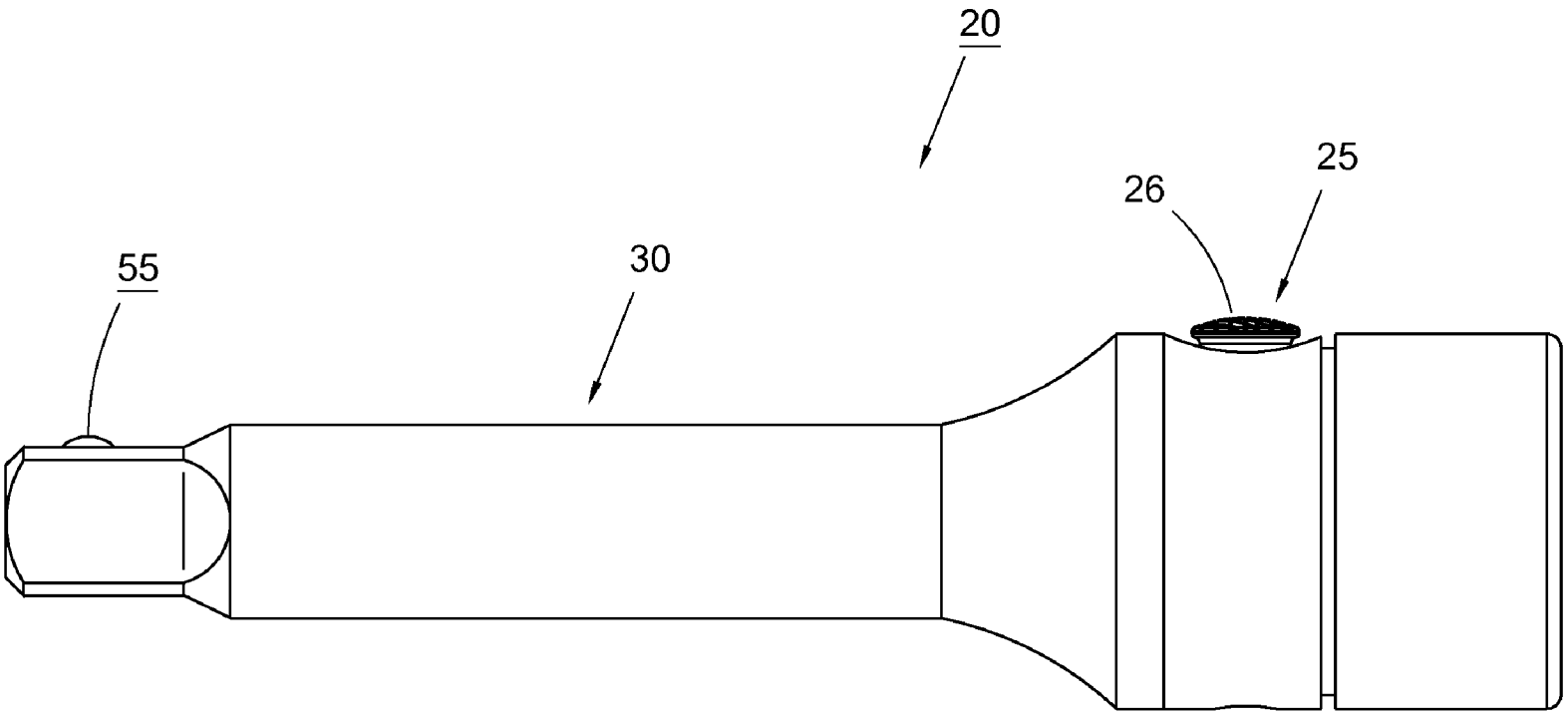
FIG. 3 is a side view of a first embodiment of the present invention.
Figure 4:
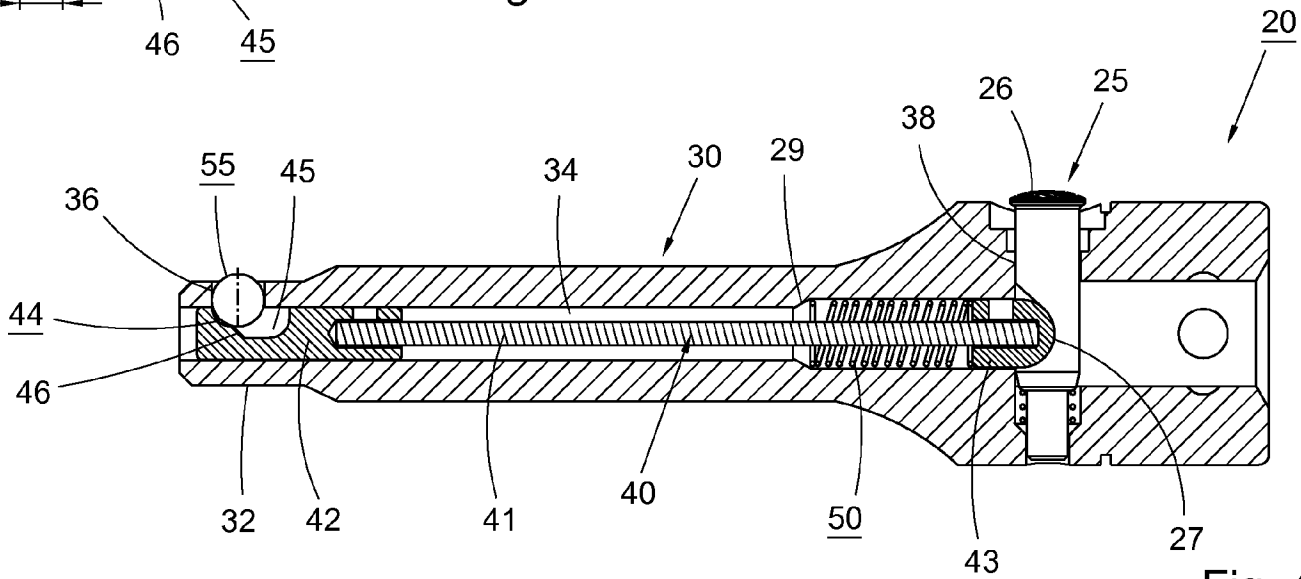
FIG. 4 is a longitudinal sectional of the first embodiment of the present invention.

Please refer to FIGS. 3 and 4. The socket connection device 20 includes a main body 30 having a front end as an insertion end 32. An axial slide passage 34 is formed in the main body 30. A through hole 36 is formed on a circumference of the insertion end 32 in communication with the slide passage 34.

Figure 5:
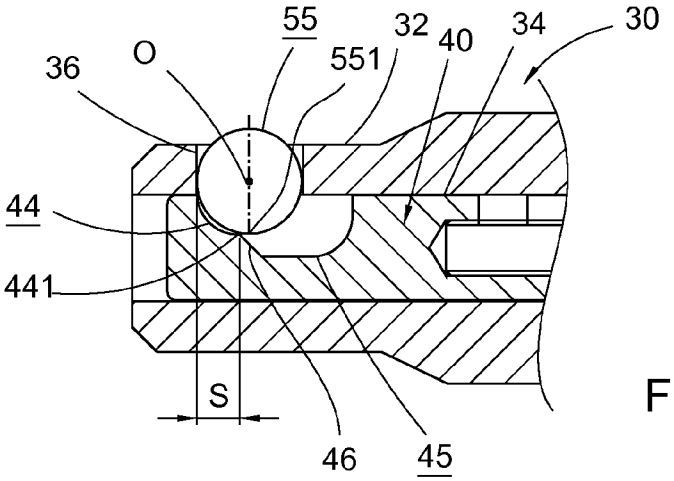
FIG. 5 is an enlarged view of a part of FIG. 4.

A slide rod 40 is installed in the slide passage 34 of the main body 30 and slidable along the slide passage. The slide rod 40 has a front end as an operation end. Referring to FIG. 5, a shallow depression 44 and a deep depression 45 are formed on a circumference of the operation end of the slide rod and adjacent to each other. A slope 46 is connected between the shallow depression and the deep depression. The deep depression 45 is positioned behind the shallow depression 44.

A resilient member 50 is disposed inside the main body 30. One end of the resilient member 50 abuts against a rear end of the slide rod. Accordingly, when free from any external force, the slide rod tends to move rearward to an engaging position where the shallow depression 44 is positioned under the through hole 36.

By means of an operation, a user can move the slide rod 40 forward to a releasing position. For example, the socket connection device 20 can have a linking mechanism 25 including a push rod 26. The push rod 26 is radially fitted in a hole 38 of the main body 30. A rear end of the slide rod 40 contacts a driving section 27 of the push rod 26. The driving section 27 can be a concave or convex structure. When pressing the push rod 26, the push rod 26 will urge the slide rod to move forward.

An engaging ball body 55 is inlaid in the through hole 36 of the main body 30 and movable along the through hole 36. In normal state, a bottom edge of the ball body 55 falls on the shallow depression 44, whereby a top edge of the ball body protrudes out of the through hole 36.

Referring to FIG. 5, the present invention is characterized in that in axial direction of the slide rod 40, the axial length S of the shallow depression 44 is shorter than a radius of the ball body 55. Therefore, a center O and a bottommost edge 551 of the ball body 55 are positioned outside a bottom wall 441 of the shallow depression 44 rather than on the bottom wall 441. The contact range between the ball body and the shallow depression is smaller than a 90-degree arc.

Moreover, in this embodiment, the slide rod 40 is composed of a slender rod 41, a large-diameter front end member 42 and a large-diameter rear end member 43. The front end member 42 is fixedly connected with a front end of the slender rod 41. The depressions 44, 45 and the slope 46 are formed on a circumference of the front end member 42. The rear end member 43 is connected with a rear end of the slender rod and contacts the driving section 27 of the push rod 26. The resilient member 50 is fitted on the slender rod 41. A first end of the resilient member 50 abuts against a front face of the rear end member 43. A second end of the resilient member 50 abuts against a shoulder section 29 of the main body.

Figure 6:
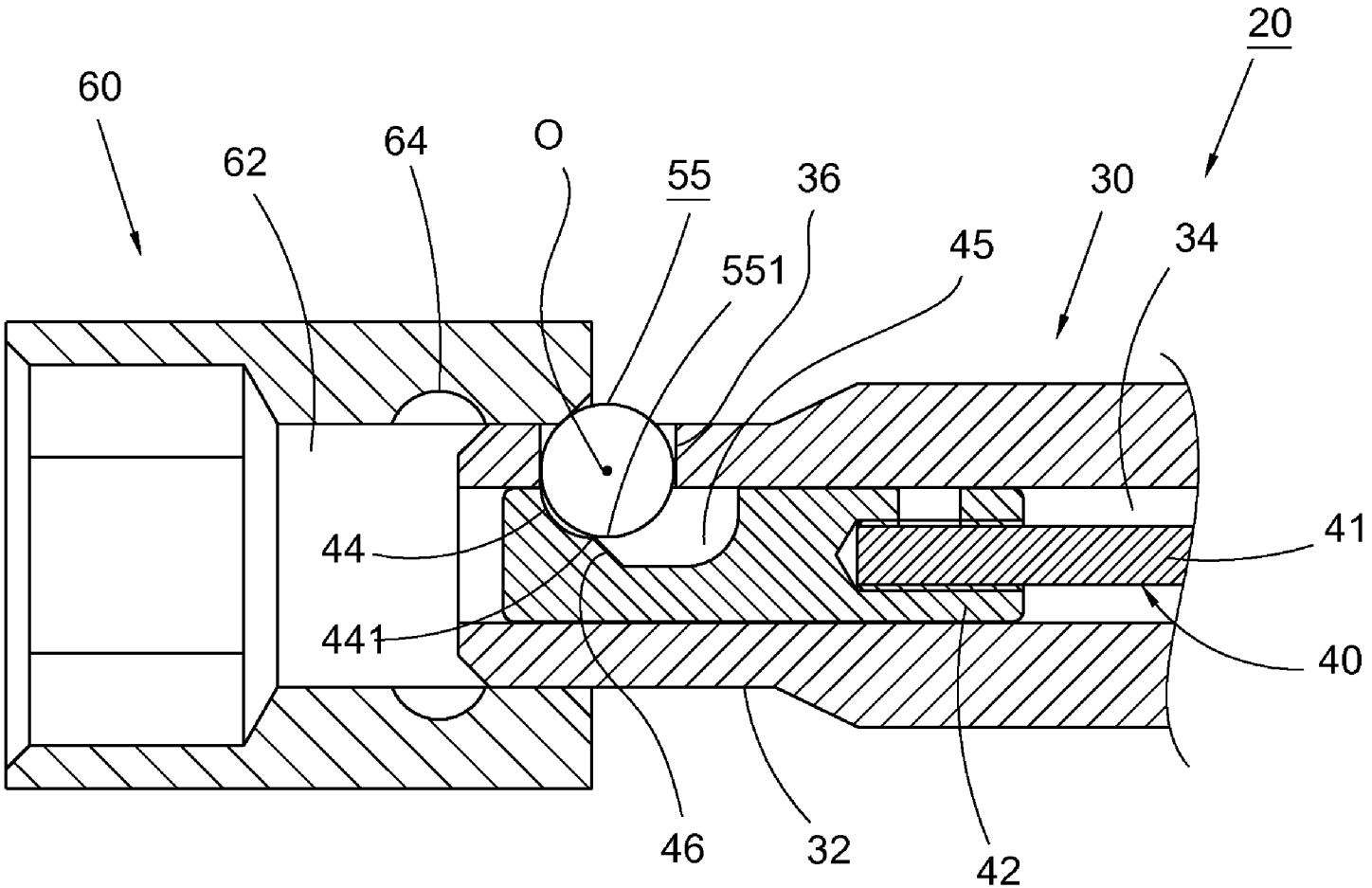
FIGS. 6 and 7 show that a socket is fitted onto the socket connection device of the present invention.
Figure 7:
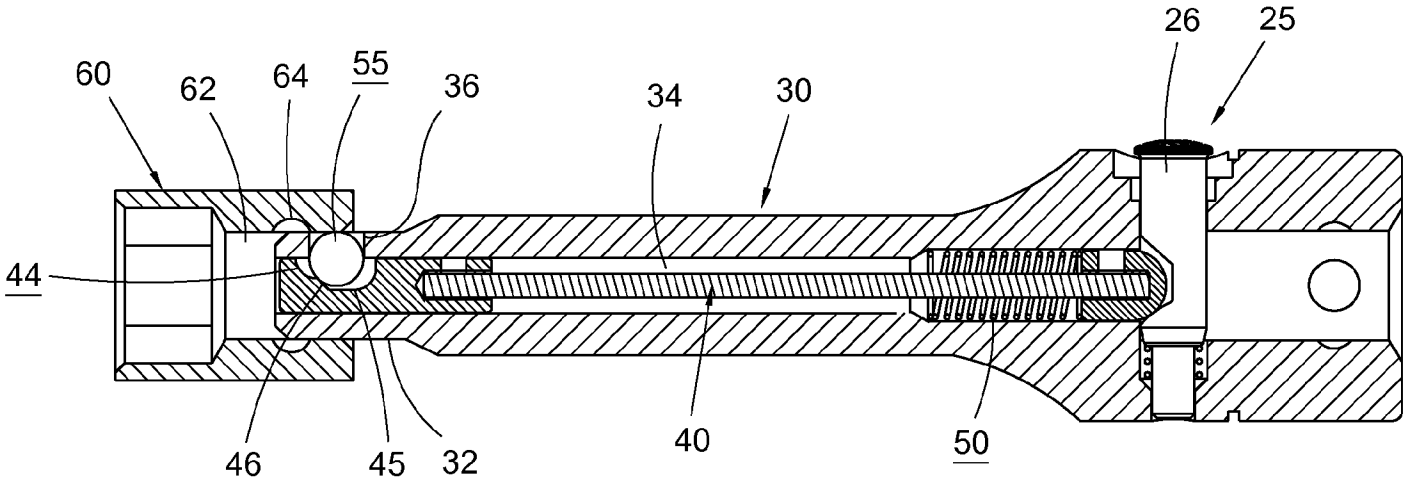

In normal state, the slide rod 40 is positioned in the engaging position and the ball body is rested on the shallow depression 44 to partially protrude from the main body 30. When connecting a socket with the socket connection device 20 of the present invention, as shown in FIG. 6, the socket 60 is fitted onto the insertion end 32 of the main body 30 and pushed inward. When the socket touches the ball body 55, the socket exerts an action force onto the ball body to make the ball body retract into the main body 30. As aforesaid, the center O of the ball body is positioned outside the bottom wall 441 of the shallow depression 44. Therefore, a convex face of the ball body contacts the bottom wall 441 rather than the bottommost edge 551 of the ball body. Therefore, the ball body 55 can push the slide rod 40 and urges the slide rod to move forward along the slide passage 34 so that the shallow depression 44 moves away from the through hole 36, as shown in FIG. 7, while the deep depression 45 approaches the through hole 36. Under such circumstance, the ball body 55 leaves the shallow depression 44 and overpasses the slope 46 to drop into the deep depression 45. Accordingly, the ball body is retracted into the through hole without protruding from the main body.

Figure 8:
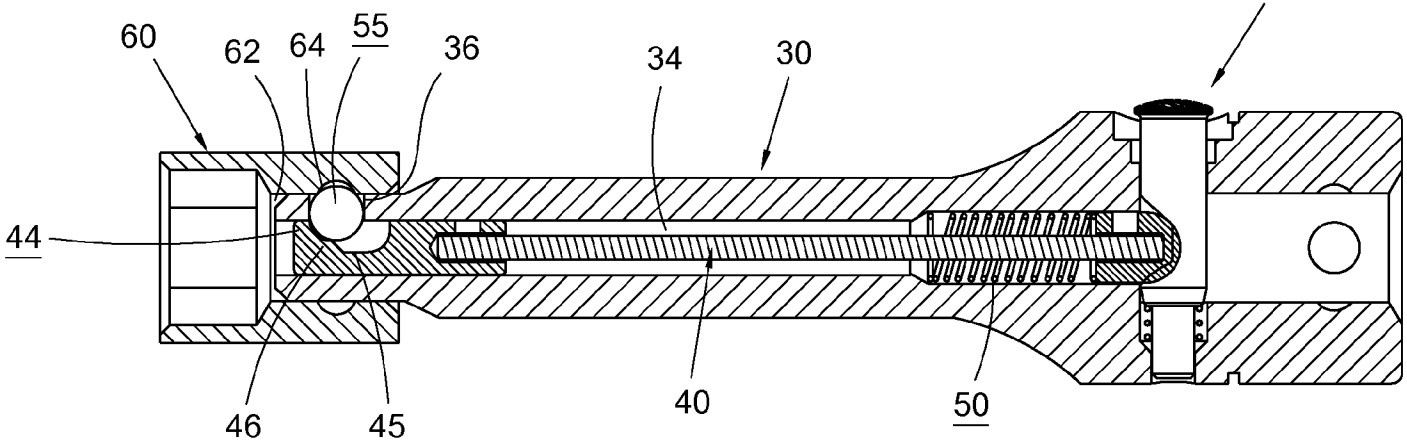
FIG. 8 shows that the socket is completely fitted on the socket connection device of the present invention.

When further pushing the socket 60, a recessed section 64 formed on an inner wall of the fitting hole 62 of the socket is moved to a position above the ball body 55. At this time, the ball body is released from the pressing of the socket, whereby the resilient member 50 pushes the slide rod 40 back to the engaging position where the ball body 55 moves back into the shallow depression 44, the top edge of the ball body again protrudes out of the through hole to engage in the recessed section 64 of the fitting hole 62 and lock the socket with the socket connection device 20 as shown in FIG. 8.

Figure 9:
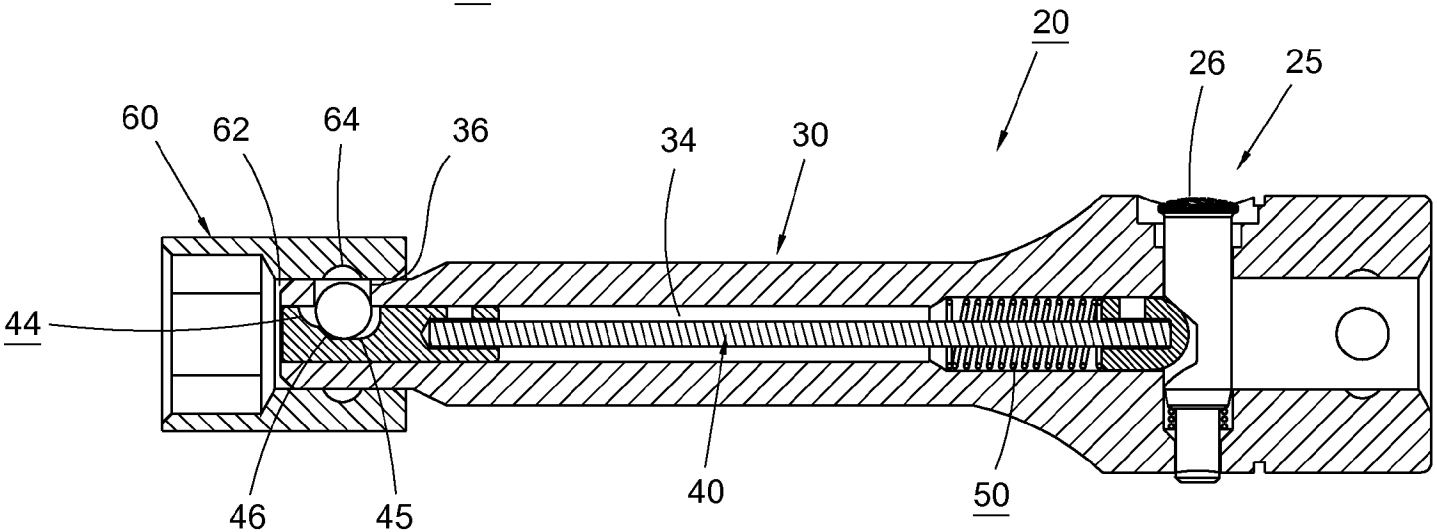
FIG. 9 shows that the socket is taken off from the socket connection device of the present invention.

When taking off the socket, a user needs to press the push rod 26 and make the slide rod 40 move forward to the releasing position as shown in FIG. 9, the shallow depression 44 moves away from the through hole 36 and the deep depression 45 moves to a position under the through hole. Under such circumstance, the ball body 55 drops into the deep depression 45 without engaging with the socket 60. In this case, the socket can be disconnected from the socket connection device 20. After that, releasing the push rod 26 from the pressing force, the resilient member 50 urges the slide rod 40 to restore to the engaging position where the ball body partially protrudes from the main body.

Figure 10:
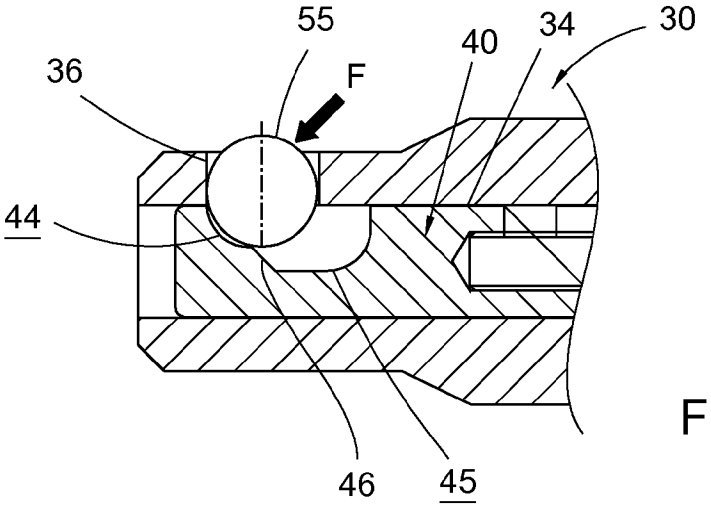
FIG. 10 is an enlarged view of a part of FIG. 8.

In use of the present invention, a user only needs to fit the socket onto the socket connection device for locking the socket therewith. It is unnecessary for the user to perform any additional operation (such as operation of the linking mechanism 25). When taking off the socket, the user needs to perform an operation to retract the ball body into the main body for separating the socket 60 from the socket connection device 20. Referring to FIG. 10, it is impossible to directly take off the socket from the socket connection device 20 without first retracting the ball body 55 into the main body. This is because under such circumstance, the action force f exerted by the socket onto the ball body is directed to the shallow depression 44 and thus the ball body can hardly drive and move the slide rod.

Figure 12:
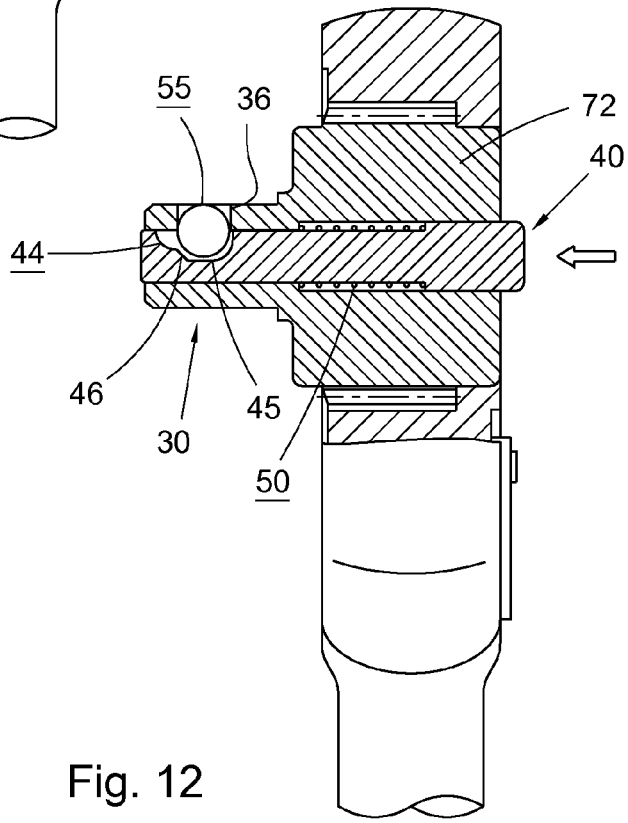
FIG. 12 is a view according to FIG. 11, showing the operation of the socket connection device of the present invention.

FIGS. 11 and 12 show a second embodiment of the socket connection device of the present invention, in which the same components are denoted by the same reference numerals as the first embodiment.

In this embodiment, the main body 30 is connected with the ratchet 72 of the ratchet wrench 70. The rear end of the slide rod 40 protrudes from the ratchet 72. In normal state, under the resilient force of the resilient member 55, the slide rod 40 is positioned in the engaging position where the top edge of the ball body 55 protrudes from the main body. When fitting a socket onto the insertion section 32 of the main body, the socket can directly urges the ball body 55 to retract into the main body for locking the socket. This operation is identical to that of the first embodiment.

When taking off the socket, as shown in FIG. 12, a user needs to press the slide rod 40 and make the slide rod 40 move forward to the releasing position where the ball body 55 retracts into the main body.

FIG. 13 shows a third embodiment of the socket connection device of the present invention, in which the main body 30 is connected with a head section 82 of the wrench 80. The locking and releasing operations of this embodiment are identical to those of the first and second embodiments.

According to the present invention, when connecting the socket with the socket connection device by means of insertion, a user can directly fit the socket onto the socket connection device to lock the socket therewith without performing any other operation. Therefore, it is very convenient to use the socket connection device.

The above embodiments are only used to illustrate the present invention, not intended to limit the scope thereof. Many modifications of the above embodiments can be made without departing from the spirit of the present invention.

What is claimed is:

1. A socket connection device comprising:

a main body having a front end as an insertion end; an axial slide passage being formed in the main body; a through hole being formed on a circumference of the insertion end in communication with the slide passage;

a slide rod installed in the slide passage of the main body and slidable along the slide passage; a shallow depression and a deep depression being formed on a circumference of a front end of the slide rod, the deep depression being positioned behind the shallow depression;

a resilient member disposed between the main body and the slide rod, whereby in normal state, under resilient force of the resilient member, the slide rod tends to move rearward to an engaging position where the shallow depression is positioned in alignment with the through hole;

a ball body inlaid in the through hole of the main body and movable along the through hole, whereby in normal state, a bottom edge of the ball body falls on the shallow depression of the slide rod and a top edge of the ball body protrudes out of the main body; when the slide rod moves forward to a releasing position, the shallow depression moving away from the through hole, while the deep depression approaching the through hole, whereby the ball body moves into the deep depression; and said socket connection device being characterized in that in the normal state, the ball body is positioned in the shallow depression with a center and a bottommost edge of the ball body positioned outside a bottom wall of the shallow depression;

in an axial direction of the slide rod, an axial length of the shallow depression is shorter than a radius of the ball body.

2. The socket connection device as claimed in claim 1, wherein a contact range between the ball body and the shallow depression is smaller than a 90-degree arc.

3. The socket connection device as claimed in claim 2, wherein a slope is connected between the shallow depression and the deep depression.

4. The socket connection device as claimed in claim 1, wherein a contact range between the ball body and the shallow depression is smaller than a 90-degree arc.

5. The socket connection device as claimed in claim 1, wherein a slope is connected between the shallow depression and the deep depression.

6. The socket connection device as claimed in claim 1, wherein a slope is connected between the shallow depression and the deep depression.

7. The socket connection device as claimed in claim 1, wherein the slide rod includes a slender rod and a front end member, the front end member having a diameter larger than that of the slender rod, the front end member being connected with a front end of the slender rod; the shallow and deep depressions being formed on a circumference of the front end member.

8. The socket connection device as claimed in claim 7, wherein the slide rod further includes a rear end member having a diameter larger than that of the slender rod, the rear end member being connected with a rear end of the slender rod; one end of the resilient member abutting against the rear end member.

9. The socket connection device as claimed in claim 1, wherein a rear end of the slide rod protrudes from the main body, whereby by means of pressing the rear end of the slide rod, the slide rod can be moved to the releasing position.

10. The socket connection device as claimed in claim 1, further comprising a linking mechanism substantially connected with the slide rod, whereby by means of operating the linking mechanism, the slide rod can be driven and moved to the releasing position.

* * * * *